United States Patent [19]

Principe et al.

[11] Patent Number: 4,832,323

[45] Date of Patent: May 23, 1989

[54] FABRIC PIN TABLE

[75] Inventors: William L. Principe, Atlanta; Jacky L. Fowler, Lawrenceville, both of Ga.

[73] Assignee: Cutting/Sewing Room Equipment Company, Inc., Atlanta, Ga.

[21] Appl. No.: 97,544

[22] Filed: Sep. 15, 1987

[51] Int. Cl.[4] ..... B23Q 3/18

[52] U.S. Cl. ..... 269/54.5; 269/54.4

[58] Field of Search ..... 269/58.5, 289 R, 292, 269/53, 54.4, 54.5, 73, 296

[56] References Cited

U.S. PATENT DOCUMENTS 3,912,249 10/1975 Vaca ..... 269/289 R

*Primary Examiner*—Gene Wan

*Attorney, Agent, or Firm*—Jones, Askew & Lunsford

[57] ABSTRACT

There is disclosed a fabric pin table having a pin holder carried by a movable rack mounted below the table. Holes or slots are provided in the table's top so that pins can be inserted through the holes or slots and into the pin holder. The pin holder clamps the pins by means of a spring so that they are held tightly but are still removable.

9 Claims, 3 Drawing Sheets

FABRIC PIN TABLE

BACKGROUND OF THE INVENTION

This invention relates generally to fabric pin tables used in the garment industry, and more particularly concerns fabric pin table which has pins connected to a pin holder beneath the table and which pins are retractable below and extendable above the working surface of the pin table.

In the production of garments, a number of garments are cut from a single pattern by first spreading a number of layers of fabric onto a cutting table. Once the fabric has been spread on the cutting table, a pattern for the garment is laid over the layers of fabric, and the pieces of the garment are cut from all the layers simultaneously by means of an electric knife. In order to produce a garment from either striped or plaid material, the cut pieces must be matched or aligned on a common stripe prior to cutting. Conventionally this is done in the garment industry on a cutting table by sticking a pin into the wooden surface of the table. The fabric is then spread by operators and manually aligned on the pins by pulling the material over the top of the pin.

Another conventional way of pinning garments on a cutting table is to have a pinning bar that is a flat metal plate with pins threaded into the plate at predetermined spacings. The bar is then clamped to the table top, and the fabric is pulled over the pins and anchored. After pinning is completed, however, the pins must be removed before the paper pattern is placed over the material, and the pieces are cut using an electric knife.

Both systems for pinning have several disadvantages. First, in order to accommodate the full thickness of a number of layers of fabric, the pins extend well above the top of the table, and pulling the fabric over the tops of the pins may stretch the fabric. Second, before cutting, the pins must be removed, and in some cases the material must be floated pneumatically to another table before cutting. Removal of pins prior to cutting results in the material shifting and in poor quality. Third, the insertion of the pins into the table top damages the table top which damage may then snag the fabric being cut.

Recently, pinning tables have been provided with a wide slot or slots extending the full length of the pinning table. Within the slots are mounted moveable supports with pins attached thereto. Once the layers of fabric have been properly positioned and pinned, the movable support is lowered removing the pins from the fabric and leaving the slot exposed. The fabric is then floated to another table where it is cut according to the pattern. Again, the removal of the pins and the floating of the fabric inevitably results in shifting and poor quality.

SUMMARY OF THE INVENTION

It is therefore an object of the present invention to provide a pin table on which a number of layers of fabric can be pinned and then cut with an electric knife while still held by pins.

It is likewise an object of the present invention to provide a pin table with pins that protrude from the surface of the pin table to a height that can be varied so that the first layers of fabric do not have to be stretched significantly in order to reach over the tops of the pins.

It is also an object of the present invention to provide a pin table that will accommodate pins of varying diameters.

In order to accomplish the foregoing objectives, a conventional cutting table has a frame mounted on the underside of the table top which frame carries a rack that is moveable forward and away from the undersurface of the table top. The rack carries one or more elongated clamps which extend in the longitudinal direction of the table top. The elongated clamps are adjustably mounted on the rack so that their position across the width of the table can be varied.

In the simplest embodiment, the pin position for a particular cutting pattern is determined on the table top, a hole is drilled in the table at the appropriate spot, and the elongated clamp is aligned under the hole. If subsequently the pin position needs to be changed for a different garment pattern, another hole is drilled, and the elongated clamp is again moved transversely to align with the hole. The elongated clamp can accept and hold a pin inserted through the hole at any position along its length. Consequently, the clamp provides an infinite number of holes and pin spacings in the top of the table along a longitudinal line. In one embodiment, a narrow slot having a width just larger than the diameter of the pin and extending parallel to the elongated clamp may be provided instead of a number of discrete holes.

The elongated clamp generally is a U-shaped member with a base, two sides, and a top opening. A leaf spring is attached to one side and extends inwardly toward the base and across the opening. As the pins are pushed into the clamp, the leaf spring engages the pin and holds it securely against the opposite side within the U-shaped channel. In another embodiment of the clamp, a threaded rod is provided along the base of the channel in order to provide support against longitudinal tipping of the pin. Once inserted, the pin is engaged by the leaf spring near the top opening and by the threads of the threaded rod near the bottom of the U-shaped channel. In another embodiment, two leaf springs may be provided spaced along one side of the U-shaped channel to provide two points of contact between the pin and each of the springs. The leaf springs enable to clamps to accommodate pins of different diameters.

Other objects and advantages of the present invention will become apparent upon reading the following detailed description and upon reference to the drawings.

DETAILED DESCRIPTION OF THE INVENTION

While the invention will be described in connection with a preferred embodiment, it will be understood that we do not intend to limit the invention to that embodiment. On the contrary, we intend to cover all alternatives, modifications, and equivalents as may be included within the spirit and scope of the invention as defined by the appended claims.

Figure 1:
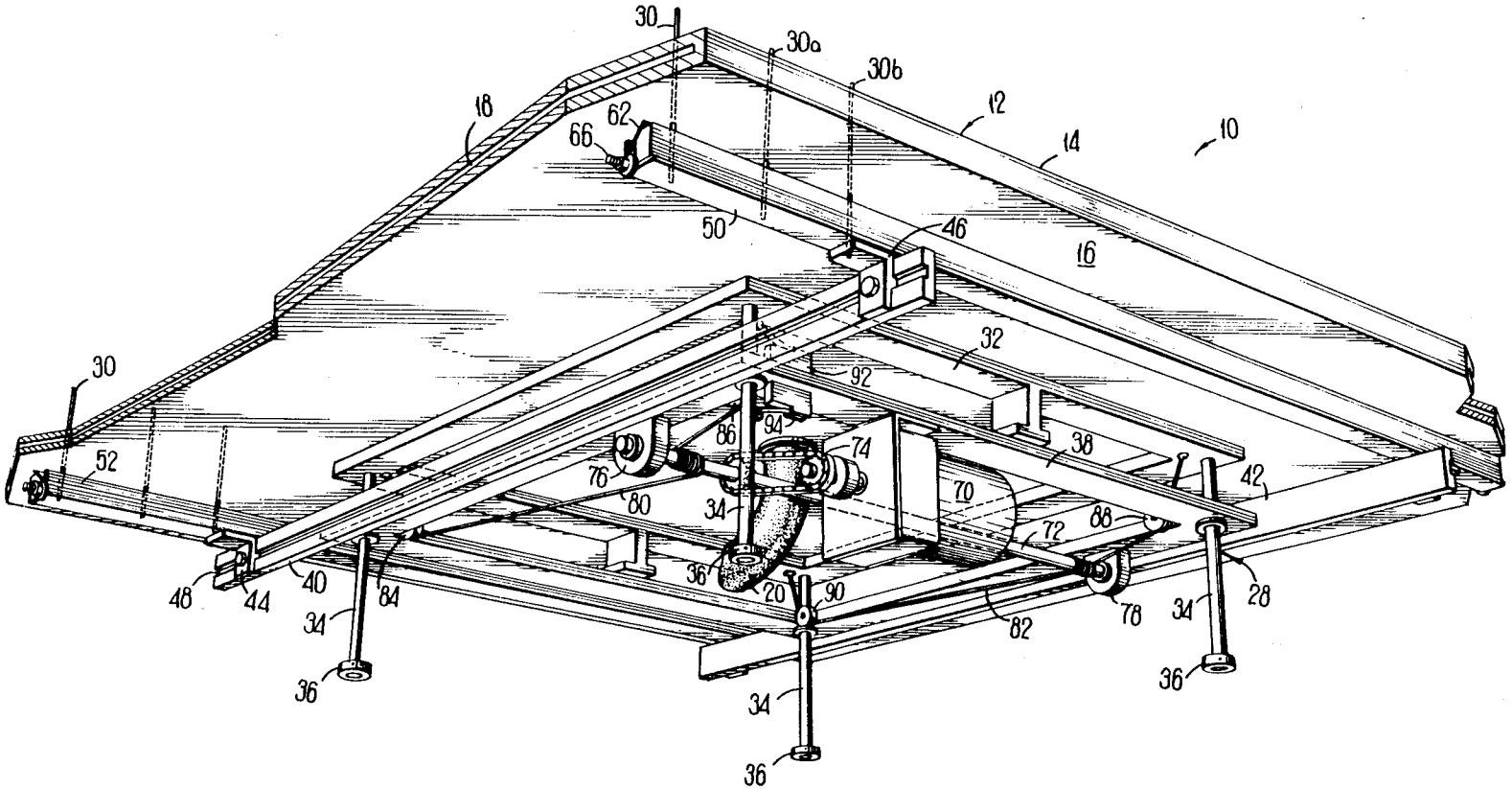
FIG. 1 is a perspective view showing the underside of the pin table of the present invention.

Turning to FIG. 1, there is shown a pin table 10 consisting of a table top 12 with a top surface 14 and an under surface 16. The table top 12 is supported on legs (not shown). The table top 12 has an air space 18 sandwiched between the top surface 14 and the bottom surface 16 which air spaced is co-extensive with the table top. The air space 18 is connected to a source of pressurized air or vacuum through port 20 on the underside 16 of the table top and to atmosphere through a number of vent holes 22 (FIG. 2) connecting the air space 18 to the top surface 14. By drawing a vacuum through port 20, fabric such as 24 on the top surface 14 can be drawn down to the table top and held in place. Likewise, a source of pressurized air connected to the port 20 can float the fabric 24 off of the top surface 24 so that the fabric can be easily moved on a thin film of air across the table top.

In order to cut a garment from either striped or plaid material, the fabric is laid in layers on the pin table 10, and each layer must be matched or aligned along a common stripe prior to cutting. In that regard, it is necessary to provide a pin 30 at a location 25 for example. The fabric such as 24 is then stretched over the top of the pin 30 and held in place while additional layers of fabric are laid on top of it. In order to provide pin 30 for holding the fabric 24 at the location 25, a hole 27 is drilled in the table at location 25, and pin 30 is inserted through the hole and held by means of a pin holding mechanism 28 mounted on the underside of the table top.

The pin holding mechanism 28 comprises a frame 32, with guide rods 34 extending downward therefrom and terminating with collars 36. A moveable rack 38 is slideably mounted on the rods 34 so that the rack 38 can move toward and away from the undersurface 16 of the table top 12. Rails 40 and 42 are mounted on each end of the rack 38, and the rails extend across the width of the table top 12. Each rail 40 and 42 has a set of brackets such as 44 and 46 of rail 40. The brackets 44 and 46 are slideably mounted and lockable along a groove 48 of the rail 40. Likewise, rail 42 has similar slideably mounted and lockable brackets (not shown). The brackets 44 and 46 on rail 40 and the similar brackets on rail 42 are attached to pin holders 50 and 52 which in the preferred embodiment are elongated and extend along the length of the table top 12. By adjusting the brackets such as 44 and 46 along the rails 40 and 42, the pin holders 50 and 52 can be moved laterally toward and away from the center of the table top 12.

Figure 2:
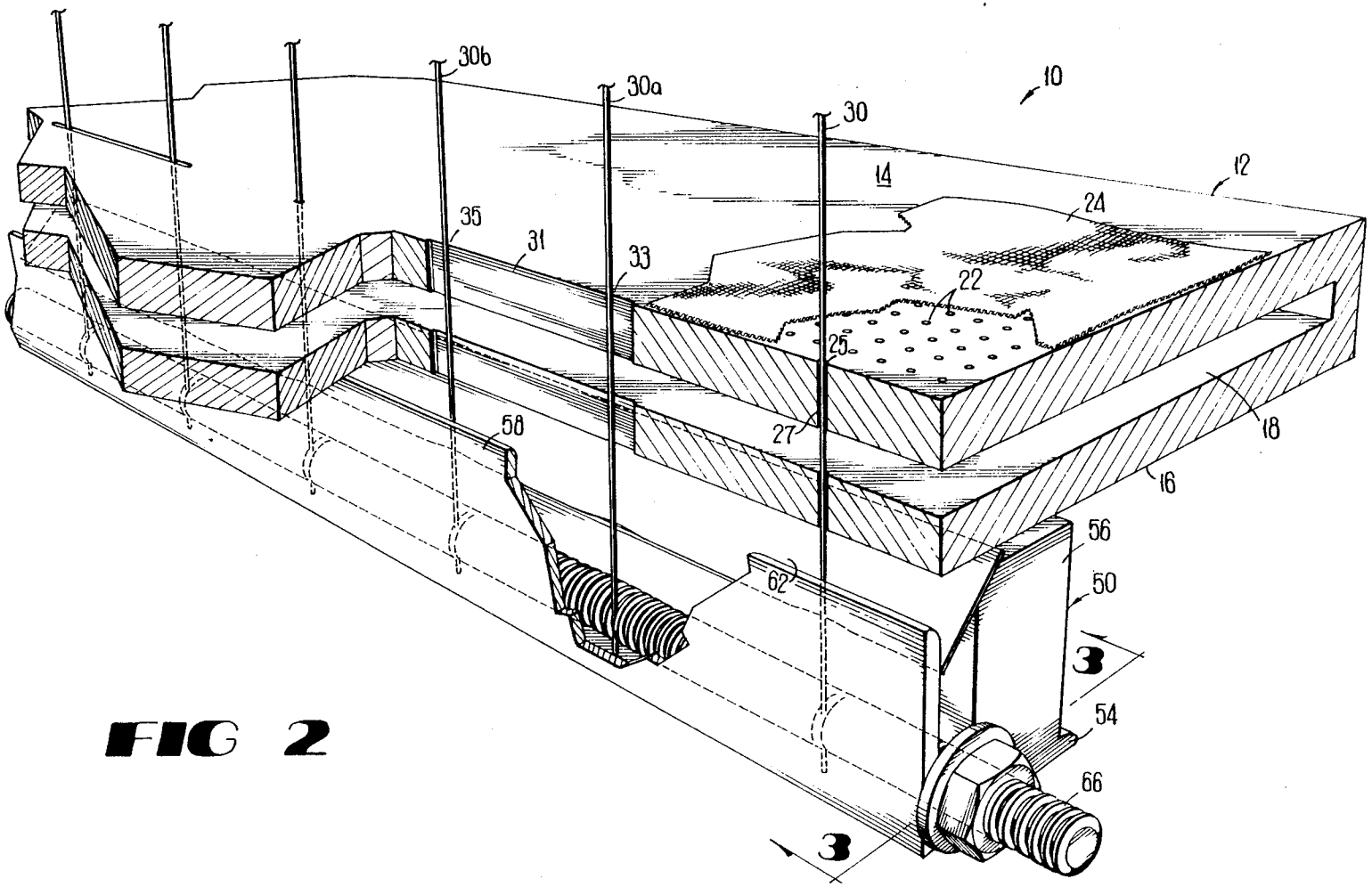
FIG. 2 is a perspective view showing a portion of the top of the pin table of the present invention.

With reference to FIG. 2, a number of pins 30, **30*a*, and 30*b* are shown held by the pin holder 50 and protruding through the table top 12. Particularly, pin 30 at location 25 extends through hole 27 and is inserted into the pin holder 50. The hole 27 is just slightly larger than pin 30 to provide ease of insertion and lateral support. Pin 30*a* at location 33 extends through elongated slot 31 and is held beneath the table top 12 by pin holder 50. Likewise, pin 30*b* at location 35 extends through the same slot 31 and is held beneath the table surface by pin holder 50. The slot 31 has a width just slightly larger than the pin width so that the pins can be easily inserted into the slot. The slot allows the pins to be moved to different positions along the length of the table top by pulling the pin out of the pin holder 50 and reinserting it at the desired location along the slot 31**.

Figure 3:
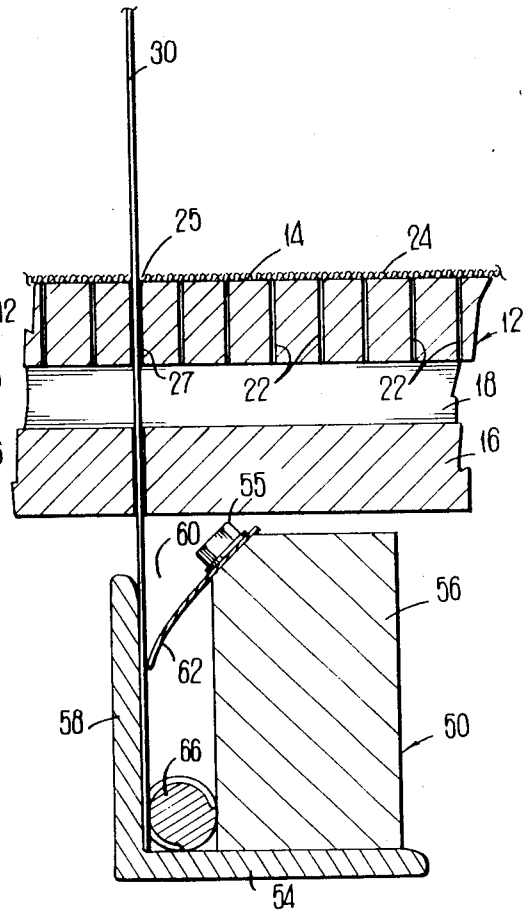
FIG. 3 is a cross-section view showing in detail the pin holder as seen along line 3—3 of FIG. 2.

With reference to FIG. 3, the pin holder 50 has a base 54, a side 56, and an opposite side 58 which together define an opening 60 for insertion of pin 30. The pin holder 50 has a leaf spring 62 connected to the block side 56 by means of a bolt 55 so that the leaf spring 60 extends inwardly toward base 54 and across the opening 60. Adjacent the base 54 is positioned a threaded rod 66 which extends along the length of the pin holder 50 and is anchored at each end by nut 59 (FIG. 2). Consequently, when the pin 30 is inserted into the opening 60, the pin 30 is engaged by the leaf spring 62 to hold it against the side wall 58 near the top of the opening 60 while the threads on the thread rod 66 arrests longitudinal movement of the pin so that the pin does not tip in a plane extending longitudinally along the pin holder 50.

Figure 4:
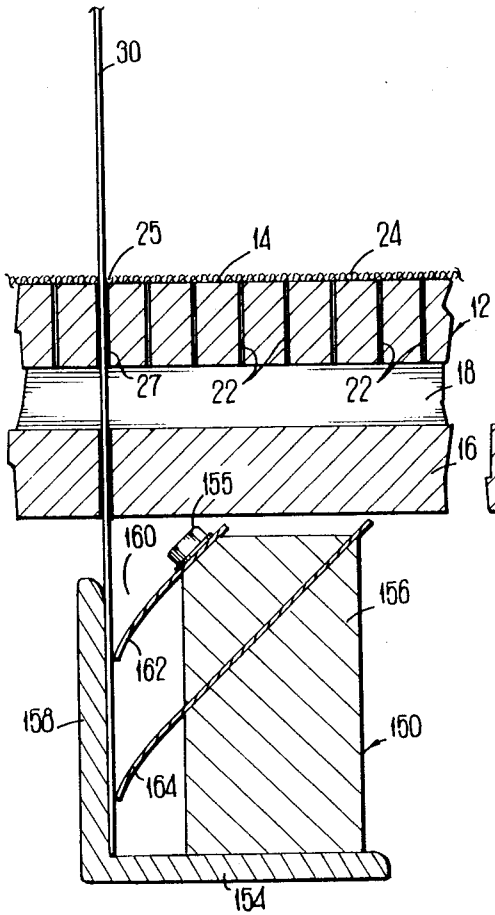
FIG. 4 is a cross-section view of another embodiment of the pin holder used in connection with the present invention.

In an alternative embodiment shown in FIG. 4, pin holder 150 has a base 154, a side 156, and a side 158. The sides 156 and 158 define an opening 160 into which a pin 30 is thrust from the top side of the table top 12 through hole 27. The pin holder 150 like the pin holder 50 has a leaf spring 162 which is attached by means of a bolt 155 to side 156 near the opening 160. In addition, the pin holder 150 has an additional leaf spring 164 which is also attached to the side 156 and extends across the opening 160 but is displaced from the leaf spring 162 toward the base 154. Consequently, as can be seen in FIG. 4, the pin 30 is held against the side 158 by both leaf springs 162 and 164 at two points thereby keeping the pin from tipping along a plane running parallel to the length of the pin holder 150.

Figure 5:
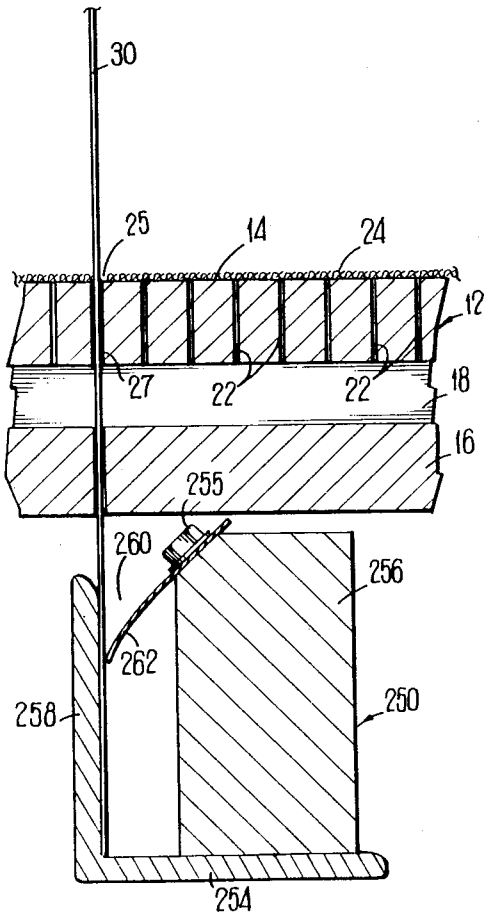
FIG. 5 is a cross-section view of yet another embodiment of the pin holder used in connection with the present invention.

A third embodiment of the pin holder is shown in Fig. 5. Pin holder 250 includes a base 254, a side 256, and a side 258. The sides 256 and 258 define an opening 260. A leaf spring 262 is attached by means of a bolt 255 to side 256 and extends inwardly and across the opening 260. The leaf spring 262 as can be seen in FIG. 5 engages the pin 30 when it is thrust through the hole 27 at location 25, through opening 60 of the pin holder and against the base 254. The spring 262 urges the pin against the side wall 258 to hold it in place.

All three embodiments of the pin holder will accommodate pins of different diameters. In general, manufacturers use pins from less than 1/16 inch to about $\frac{1}{8}$ inch in diameter. In order to adapt the pin table of the present invention to a different diameter pin, it is only necessary to drill the appropriate size hole (or route the appropriate size slot) in the top of the pin table.

In accordance with an important aspect of the present invention, the pin 30, once engaged and held by the pin holder 50, can be raised and lowered. Consequently, when the first layer of fabric such as 24 in FIG. 3 is first laid on the table top, the pin 30 is positioned to extend only a very short distance so it is not necessary to stretch the fabric very much to make it reach over the top of the pin. As additional layers are built up, the pin 30 is advanced as necessary in order to extend through the entire thickness of the multiple layers of fabric but no higher than necessary to minimize the amount of stretching required to pull the next layer over the top of the pin.

In order to raise and lower the pin 30, there is shown in FIG. 1 means for raising and lowering the rack 38 along rods 34. Particularly, a motor 70 which is mounted on rack 38 drives a shaft 72 by means of a chain 74. The motor 70 is reversible so that the shaft 72 can be driven in either direction. The shaft 72 is mounted on bearings 76 and 78 attached to the rack 38, and the shaft 72 has cables 80 and 82 wound around each end of it. The cables 80 and 82 are connected via pulleys 84, 86, 88, and 90 to each of four corners of the frame 32. As the motor 70 turns counterclockwise as shown in FIG. 1, the cables 80 and 82 wind up on the shaft and pull the rack 38 toward the underside of the table top thereby carrying the pin holder 50 and the pins 30, 30*a*, and 30*b* upward. A limit switch 92 attached to the rack 38 limits the upward travel of the rack. When the motor rotates clockwise as shown in FIG. 1, the cables 80 and 82 unwind from the shaft 72, and the rack 34 lowers until limit switch 94 contacts collars 34 to thereby limit the downward travel and the retraction of the pins 30, 30*a*, and 30*b*.

We claim:

1. A fabric pin table comprising:

a. a table having supporting legs and a top with an upper working surface, an undersurface, and a hole through the top;

b. a frame mounted below the undersurface and having a movable rack which moves on the frame toward and away from the undersurface, which rack has attached thereto a clamp aligned with the hole for engaging and holding a pin insert through the hole.

2. The pin table of claim 1, wherein the pin has a length so that when the pin is engaged by the clamp and when the rack is moved away from the undersurface, the pin is withdrawn in the hole below the upper working surface of the table top.

3. The pin table of claim 1, wherein the clamp is elongated.

4. The pin table of claim 1 or 3, wherein the pin has a pin diameter and the hole is a round hole with a diameter just larger than the pin diameter.

5. The pin table of claim 3, wherein the pin has a pin diameter and the hole is a slot with a length parallel to the length of the elongated clamp and with a width just larger than the pin diameter.

6. The pin table of claim 3, wherein the elongated clamp comprises a channel member with a base, two sides, and an opening and a leaf spring mounted on one side of the channel member and tilted toward the base and closing the opening.

7. The pin table of claim 6, wherein the elongated clamp further includes a threaded rod extending the length of the clamp and adjacent the base.

8. The pin table of claim 6, wherein the elongated clamp includes a plurality of leaf springs extending parallel to each other and space between the opening and base.

9. The pin table of claim 3, wherein the clamp extends a portion of the length of the table top.

* * * * *